US009108890B2

(12) United States Patent
Vu

(10) Patent No.: US 9,108,890 B2
(45) Date of Patent: Aug. 18, 2015

(54) PROCESS FOR PRODUCING NON-DETONABLE TRAINING AID MATERIALS FOR DETECTING EXPLOSIVES

(71) Applicant: The Johns Hopkins University, Baltimore, MD (US)

(72) Inventor: Doan-Trang T. Vu, Springfield, VA (US)

(73) Assignee: The Johns Hopkins University, Baltimore, MD (US)

( * ) Notice: Subject to any disclaimer, the term of this patent is extended or adjusted under 35 U.S.C. 154(b) by 237 days.

(21) Appl. No.: 13/775,463

(22) Filed: Feb. 25, 2013

(65) Prior Publication Data

US 2014/0097551 A1 Apr. 10, 2014

Related U.S. Application Data

(60) Provisional application No. 61/709,389, filed on Oct. 4, 2012.

(51) Int. Cl.
*C06B 21/00* (2006.01)
*C06B 23/00* (2006.01)

(52) U.S. Cl.
CPC ..... *C06B 21/0083* (2013.01); *C06B 21/00* (2013.01); *C06B 23/00* (2013.01)

(58) Field of Classification Search
CPC ..... C06B 21/00; C06B 21/0083
USPC ..... 264/3.1, 3.4
See application file for complete search history.

(56) References Cited

U.S. PATENT DOCUMENTS

| | | | | |
|---|---|---|---|---|
| 5,413,812 | A | 5/1995 | Simpson et al. | |
| 5,628,008 | A * | 5/1997 | Hayashi | 715/219 |
| 5,648,636 | A | 7/1997 | Simpson et al. | |
| 7,932,089 | B2 | 4/2011 | Cohen-Arazi et al. | |
| 8,172,967 | B1 | 5/2012 | Wartman et al. | |

(Continued)

OTHER PUBLICATIONS

Phelan, James M., et al., "Sublimation Rates of Explosive Materials—Method Development and Initial Results". Sandia Report, Sep. 2004, pp. 1-22.*

(Continued)

*Primary Examiner* — Bret Chen
(74) *Attorney, Agent, or Firm* — Noah J. Hayward

(57) ABSTRACT

A method for manufacturing training aid materials for detecting homemade explosives includes spreading an explosive powder on a porous surface, storing the surface in a container that facilitates sublimation of the explosive powder such that the explosive powder redeposits onto the surface and into the pores over a period of time, and removing the surface from the container after the period of time to yield training aid materials. An additional method includes preparing a dilute solution of an explosive reaction mixture, and depositing the dilute solution on a surface prior to formation of an explosive product by the explosive reaction mixture. The surface is stored in a contain that facilitates formation of the explosive product, and removed after a period of time and cleaned to remove unreacted precursors to yield training aid materials.

18 Claims, 3 Drawing Sheets

(56) References Cited

U.S. PATENT DOCUMENTS

| | | | | |
|---|---|---|---|---|
| 2006/0037509 | A1* | 2/2006 | Kneisl | 102/355 |
| 2006/0039840 | A1* | 2/2006 | Chia et al. | 422/305 |
| 2007/0221087 | A1 | 9/2007 | Adebimpe et al. | |
| 2007/0281358 | A1* | 12/2007 | Cohen-Arazi et al. | 436/8 |
| 2008/0248578 | A1* | 10/2008 | Deans et al. | 436/8 |
| 2008/0295783 | A1* | 12/2008 | Furton et al. | 119/712 |
| 2009/0194744 | A1* | 8/2009 | Adebimpe | 252/408.1 |
| 2009/0199936 | A1* | 8/2009 | Hagit et al. | 149/33 |
| 2010/0231389 | A1* | 9/2010 | Zank et al. | 340/572.8 |
| 2012/0090744 | A1 | 4/2012 | Waldvogel et al. | |
| 2012/0156795 | A1* | 6/2012 | Apblett et al. | 436/164 |

OTHER PUBLICATIONS

Tung, Y.S., et al., "The Study of Sublimation Rates and Nucleation and Growth of TNT and PETN on Silica and Graphite Surfaces by Optical and Atomic Force Microscopy and Ellipsometry". Atomic Force Microscopy/Scanning Tunneling Microscopy 3, edited by S H Cohen and M L Lightbody, Kluwer Academic/Plenum Publishers, 1999, pp. 135-152.*

* cited by examiner

PROCESS FOR PRODUCING NON-DETONABLE TRAINING AID MATERIALS FOR DETECTING EXPLOSIVES

CROSS-REFERENCE TO RELATED APPLICATION

This application claims priority to and the benefit of U.S. Provisional Application No. 61/709,389 filed on Oct. 4, 2012, the entire contents of which is hereby incorporated herein by reference.

STATEMENT OF GOVERNMENTAL INTEREST

The subject matter of this application was made with government support under contract number HSHQDC-11-C-00005 awarded by the Department of Homeland Security. The government has certain rights in the invention.

BACKGROUND

Example embodiments generally relate to producing non-detonable explosive samples and, more particularly, to producing such samples for use as training aids.

Non-detonable training aid materials have been developed for allowing training of explosives detection dogs (EDD), dolphins, or other living or non-living entities that can detect presence of explosives through emitted vapors. The training aid materials desirably exude the same odor as bulk quantities of real explosives, but lack the detonable properties of real explosives and are otherwise safe to handle. Furthermore, the training aid materials can preferably produce vapors that exude the odor for at least a specific period of time after opening the package (e.g., 2 hours). Such training aid materials have been developed for peroxide-based homemade explosives (HME) allowing for training EDDs to detect such explosives in various environments.

Some training aid materials are formed by coating materials with layers of the explosive molecules as dissolved in a solvent. These materials can similarly produce off-odors, however, due to addition of the solvent.

BRIEF SUMMARY

Accordingly, some example embodiments may allow production of non-detonable training aid materials with no off-odor caused by mixing with solvents or other substances. In one embodiment, a porous surface of a training aid material can be covered with an explosive powder, and the explosive powder can be allowed to distribute throughout the surface and pores by a sublimation process. For example, a pure explosive powder is synthesized and spread to cover a glass microfiber filter. The filter is then stored so as to allow the sublimation process; this can include storage in a container that has properties to facilitate the sublimation. When the filters are removed from storage, they can emit vapor of the explosive at a rate comparable to large amounts of the explosive powder, and can thus be used as training aids for vapor detectors such as explosives detection dogs.

In additional embodiments, an explosive reaction mixture can be produced and added to an inert matrix, such as diatomaceous earth (DE) powder, before a reaction occurs in the mixture. The amount of mixture used can be substantially low to prevent the formulation from being detonable. In any case, using the explosive reaction mixtures in forming the training aids provides for emission of more accurate odor vapor to facilitate improved training of explosive vapor detectors.

BRIEF DESCRIPTION OF THE DRAWINGS

Figure 1:
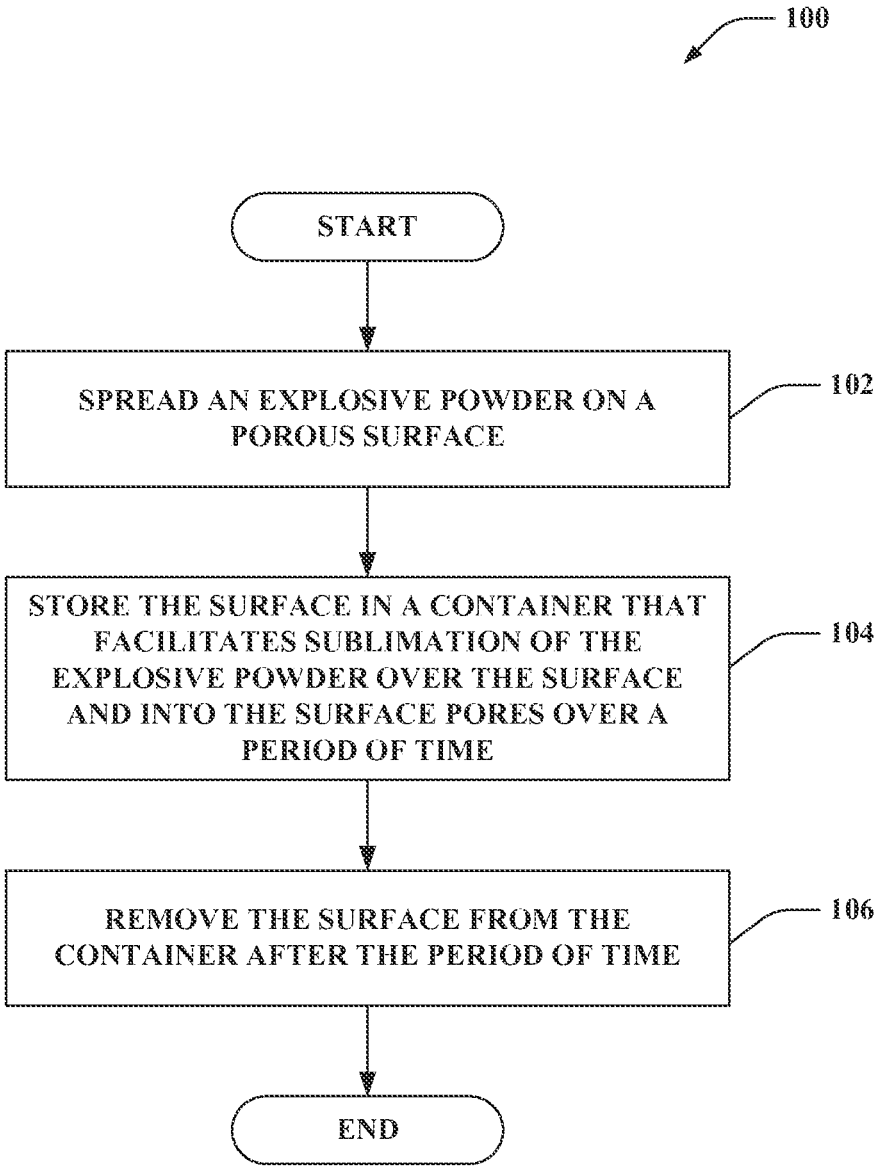
Figure 2:
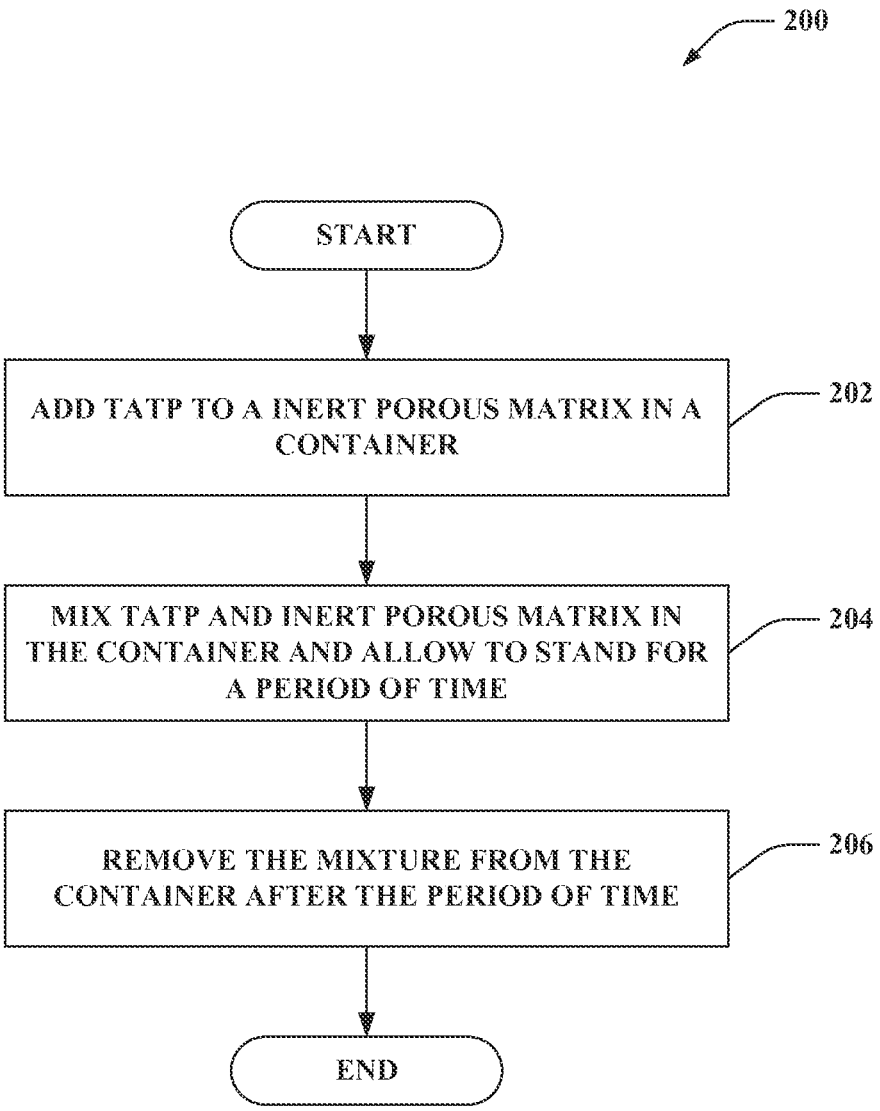
Figure 3:
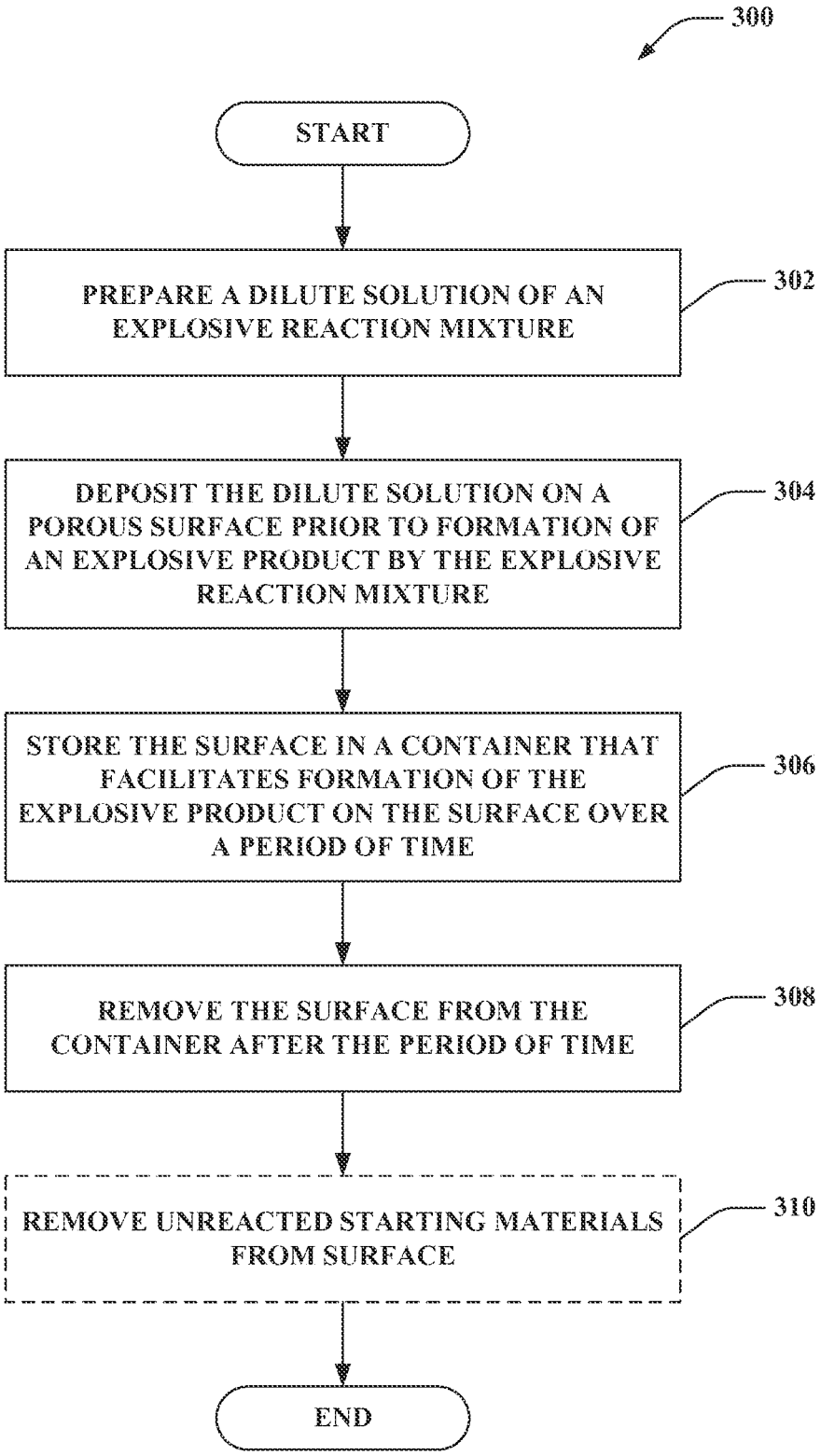

Having thus described example embodiments of the invention in general terms, reference will now be made to the accompanying drawings, which are not necessarily drawn to scale, and wherein:

FIG. 1 is an illustration of an example methodology for constructing training aid materials, for training relative to detecting explosive devices, by spreading explosive powder over a porous surface according to an example embodiment;

FIG. 2 is an illustration of an example methodology for constructing training aid materials for detecting explosive devices by adding explosive powder to an inert porous, high surface area matrix according to an example embodiment; and FIG. 3 is an illustration of an example methodology for constructing training aid materials for detecting explosive devices by diluting an explosive reaction mixture according to an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

Some example embodiments may enable manufacturing of training aid materials for detecting explosives. For example, the training aid materials can be non-detonable while exuding similar vapors at similar rates as detonable equivalents. Construction of the training aid materials, as provided herein, can use pure explosive powders to mitigate off-odors, e.g., odors other than of the explosive (or a training aid therefore) itself, typically caused by blending with solvents or other chemicals. In specific examples, explosive powders can be stored in a container to allow sublimation of the powder over and into a porous surface. The surface can then exude vapors with properties of the explosive powder to facilitate olfactory or other vapor-based detection. In other examples, an explosive reaction mixture can cover a porous surface prior to formation of the explosive, and can be subsequently stored until reaction occurs to form the explosive such that the surface can exude the explosive vapors. In both cases, the amount of explosive powder or product used can be sufficiently small or otherwise diluted such that the explosive becomes non-detonable and can thus be used as a training aid for explosive vapor detectors (such as explosives detecting dogs (EDD)).

Referring to FIGS. 1-3, methodologies that can be utilized in accordance with various aspects described herein are illustrated. While, for purposes of simplicity of explanation, the methodologies are shown and described as a series of acts, it is to be understood and appreciated that the methodology is not limited by the order of acts, as some acts can, in accordance with one or more aspects, occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with one or more aspects.

FIG. 1 illustrates an example methodology 100 for manufacturing non-detonable training aid materials for detecting explosives. At operation 102, an explosive powder is spread on a porous surface. For example, this can include spreading the powder, which is a neat, pure, or other formulation of the explosive powder without additives, on a glass microfiber filter or other high surface area surface. In another example, this can include blending the explosive powder with an inert porous matrix, such as diatomaceous earth (DE), having a high surface area. The amount of powder spread over a porous surface of a given area can be limited to result in a non-detonable surface, as described in specific examples herein. In any case, this can yield a small amount of explosive powder spread over the high surface area.

At operation 104, the surface can be stored in a container that facilitates sublimation of the explosive powder over the surface and into the surface pores over a period of time. In one example, while stored in the container, the sublimation process causes the explosive powder to redeposit onto and/or into the surface (e.g., the glass microfiber filter, DE, etc.). For example, the container can be multiple layers of aluminum foil, multiple stackable aluminum dishes or dishes of other materials, one or more glass jars, which can have substantially air tight lids, etc., or substantially any container that allows the sublimation to occur. In one example, the container can have a substantially similar diameter as the surface (and/or similar to a length of the surface where the surface is not circular). Moreover, it is to be appreciated that multiple surfaces can be stored in a single container, in some examples.

At operation 106, the surface can be removed from the container after the period of time. Thus, the explosive powder can have been redeposited onto the surface at this time, as described. Though the amount of explosive powder used in this process is significantly less than that required to construct an explosive device, the surface can exude vapors of the explosive powder at a rate that is at least comparable to an amount of explosive powder used in an explosive device. Example test scenarios are described below that show this property of training aid materials constructed according to this method. The removed surface can be used as the manufactured training aid material, or can otherwise be used in constructing a training aid for the explosive powder. In this regard, a non-detonable explosive device training aid is constructed without using solvents or other products that can cause off-odors.

In one specific example, an amount of neat triacetone triperoxide (TATP) powder equaling approximately 5-15% mass loading can be gently spread to cover the surface of a glass microfiber filter at operation 102. The filter can then be tightly wrapped between two aluminum foil layers and allowed to stand for 12 or more hours before use at operation 104. Alternatively, multiple filters are made at operation 102 by spreading the TATP on each filter and then, at operation 104, stacking the filters on top of each other and storing the stack in a tight fitting container, such as in a glass jar or between two aluminum dishes with similar diameter for filter circles or tightly foil wrapped for long filter strips. In any case, the majority of sublimed TATP is forced to redeposit onto and into the filters while stored, thus providing a training aid material with a small amount of TATP spread over a large surface area. When unwrapped, these TATP loaded filters can emit TATP vapor at a rate comparable to or much greater than that from a larger amounts of neat TATP powder, as described further herein.

FIG. 2 also illustrates a methodology 200 for manufacturing training aid materials for explosive vapor detectors (e.g., EDDs). At operation 202, TATP is added to an inert porous matrix in a container. This can be a neat or otherwise pure formulation of TATP powder without additives. For example, the inert matrix can include DE or other porous, high surface area matrices to allow for a high surface to explosive powder ratio, which can render a resulting mixture non-detonable.

At operation 204, the TATP and inert porous matrix can be mixed in the container and allowed to stand for a period of time. The mixing can be performed using substantially any mixer suitable for mixing powders. Moreover, the period of time for storing the mixture can be sufficient to allow sublimation of the TATP over the inert porous matrix.

At operation 206, the mixture is removed from the container after the period of time. As described, the TATP is thus redeposited over the inert porous matrix. The mixture can exude vapors at a rate at least as high as explosive amounts of TATP without being detonable itself. Thus, the removed mixture can be used as the manufactured training aid material, or can otherwise be used in constructing a training aid for the explosive powder. In this regard, a non-detonable explosive device training aid is constructed without using solvents or other products that can cause off-odors.

In a specific example, enough neat TATP powder is added to an inert, high purity, high surface area matrix, such as a United States Pharmacopeia/National Formulary (USP/NF)-grade DE powder, to give approximately 9% TATP mass loading at operation 202. The glass jar containing the mixture is briefly dry mixed using a wiggle bug, and the mixture is stored at least 12 h before use at operation 204. Batch mixtures (e.g., 4 g P300+0.4 g TATP) or single training aid mixtures (0.5 g P300+0.05 g TATP) give similar emission rates that are comparable to that measured from a much larger amount of neat TATP, and thus batches can be constructed according to this method. The mixture is removed at operation 206 and can be used to produce training aid materials.

In either construction of FIG. 1 or FIG. 2, or other constructions using TATP powders, it is to be appreciated that the TATP powder used can be a neat TATP powder formed using the following process or a similar process, or otherwise acquired. In one example of making neat TATP powder for use in constructing training aids, 34 g of 35% hydrogen peroxide is diluted to 31% by the addition of 5 g water. 20 mL acetone is added to the hydrogen peroxide, and the mixture is cooled in an ice bath to below 10° C. 1 mL concentrated (36%) hydrochloric acid is added dropwise to the acetone/peroxide solution at a rate as to maintain a reaction temperature at or below 10° C. Stirring is maintained throughout the acid addition. At the end of the addition, stirring is continued while the reaction mixture is kept in the ice bath for about 3 hours and then allowed to slowly warm to room temperature overnight as the ice melted. The TATP product, a fine white powder, is collected by vacuum filtration and washed with several portions of water, then a weak (2-10%) aqueous solution of sodium bicarbonate until the filtrate is no longer acidic, then more water until the filtrate is essentially neutral (pH~7). The solid product can be dried by pulling air through it while it is contained in the vacuum filter funnel resulting in the neat TATP powder that can be used to construct the training aid materials, as described. It is to be appreciated that other amounts of peroxide, water, acetone, hydrochloric acid, etc. and/or types of materials can be used, so long as TATP powder is produced without solvents or other chemicals that may produce off-odors.

In a specific example, results from example testing of training aids manufactured using processes similar to those described are shown in the below table. Even training aids that had been used for canine testing still emitted TATP vapor at a rate comparable to freshly prepared, unused training aids.

| Training Aid Sample | Matrix Mass mg | TATP Mass mg | Measurement Session | Average Emission Rate, μg/min |
|---|---|---|---|---|
| 5 cm × 31 cm filter | 990 | 50 | 2 h 28 m | 225 |
| 5 cm × 31 cm filter | 990 | 66 | 0 –> 8 h | 267 –> 17 |
| 4.25 cm circle filter | 91 | 8 | 2 h 35 m | 27 |
| 4.25 cm circle filter | 91 | 12 | 3 h 42 m | 33 |
| 4.25 cm circle filter | 94 | 5 | 2 h 44 m | 27 |
| 0.5 g 9% TATP/P300 | 457 | 46 | 3 h 32 m | 42 |
| 0.5 g 10% TATP/P300 | 420 | 48 | 3 h 24 m | 44 |
| 0.5 g 10% TATP/P300 | 446 | 49 | 1 h 11 m | 45 |
| 0.5 g 10% TATP/P300 | 448 | 50 | 1 h 11 m | 45 |
| Neat TATP spread over ~5 cm glass dish | | 200 | 2 h 1 m | 34 |
| Neat TATP contained in a vial measuring 22 m diameter by 49 mm height | | 200 | 0 –> 1 h | 122 –> 7 |
| Neat TATP contained in a vial measuring 22 m diameter by 49 mm height | | 1000 | 0 –> 1 h | 300 –> 22 |

Moreover, in a specific example, certain testing yielded that TATP loaded filters or DE powder burned vigorously but significantly weaker than neat TATP in flame tests; neither showed detonation tendencies in the flame tests. Preliminary impact test results indicated that neither filters nor DE powders were initiated by the drop of a 5.640 kg weight from a height of 2.6" onto a 0.25" diameter surface. In an additional example, third party testing performed in accordance with the United Nations "Recommendations on the Transport of Dangerous Goods Manual of Tests and Criteria" Test 3(a)(1) for impact sensitivity and Test 3(b)(i) for friction sensitivity confirm that example TATP training aids formulated using similar processes as described above have been sufficiently desensitized as not to fall under the dangerous goods shipping requirements. Criteria for passing the impact and friction tests are, respectively, an $H_{50}$ distance of greater than 10 cm (3.94 inches) and a limiting load of greater than or equal to 80N. $H_{50}$ is height at which 5 out of 10 trials result in a positive test. Results of example tests for training aid materials constructed using similar processes as described above are shown in the following table.

| Training Aid Sample | Bureau of Explosives (BOE) Impact Test Results | Bundesanstalt für Materialforschung und - prüfung (BAM) Friction Test Results |
|---|---|---|
| 8% TATP on 5 cm × 31 cm filter | No positive results in trials conducted at drop heights of up to 30 inches. | Limiting load = 216N |
| 10% TATP on 4.25 cm filter | | Limiting load = 160N |
| 12% TATP on 4.25 cm filter | | Limiting load = 96N |
| 15% TATP on 4.25 cm filter | | Limiting load = 80N |
| 9% TATP/P300 | | Limiting load = 84N |
| Neat (100%) TATP | $H_{50}$ positive distance = 2.64 cm | Limiting load < 5N |

In this testing example, one gram of 9% TATP/P300 was wrapped in a ~1"×2" foil packet and initiated with an electric match; the packet puffed up but did not detonate. For comparison, in a testing example, one gram of neat TATP similarly prepared detonated with a loud report and observable detonation wave.

In additional example testing, a group of four canines (EDDs) that had never been exposed to neat TATP were imprinted on a TATP loaded 4.25 cm filter containing 26 mg TATP (12%). Blind testing showed that these canines successfully located not only the TATP/P300 training aids but also 1 g neat TATP that was synthesized by an external organization. A group of seven canines that had trained on 1 g neat TATP synthesized by an external organization successfully located both the TATP filters and TATP/P300 (0.5 g portions). The table below summarizes results of this test.

| | Test Aids - # detection/# exposures (detection rate) | | |
|---|---|---|---|
| Imprint aid | 1 g neat TATP | TATP filter, 4.25 cm | TATP/P300 |
| TATP filter, 4.25 cm | 7/9 (78%) | 9/9 (100%) | 9/9 (100%) |
| 1 g neat TATP | 14/20 (70%) | 17/20 (85%) | 19/20 (95%) |

FIG. 3 illustrates an example methodology 300 for constructing training aid materials for explosive vapor detectors (e.g., EDDs). At operation 302, a dilute solution of an explosive reaction mixture can be prepared. This can include mixing at least a portion of an explosive reaction mixture with water. In one example, one component of the mixture can be diluted with water before adding the other reactants. Moreover, in an example, the diluted reactant can be cooled prior to adding the other reactants to slow down the reaction rate and prevent the immediate formation of the explosive when the all the reactants are combined.

At operation 304, the dilute solution can be deposited on a porous surface prior to formation of an explosive product by the explosive reaction mixture. For example, the surface can include one or more glass microfiber filters, or other porous, high surface area surface. In another example, the surface can include an inert porous matrix, such as DE, having a high surface area. In either case, this can yield a small amount of explosive reaction mixture spread over the high surface area.

At operation 306, the surface is stored in a container that facilitates formation of the explosive product on the inert surface over a period of time. For example, the container can include an aluminum weighing dish, a glass jar, etc., as described, and the explosive reaction mixture can begin to react forming the explosive product over time. In this regard, the explosive product itself is formed on the inert surface from the explosive reaction mixture. In one example, continuous or intermittent stirring or other blending of the mixture, and/or the like, can be used to ensure more uniform distribution of the explosive product over the inert surface.

At operation 308, the now explosive-loaded surface is removed from the container after the period of time. At operation 310, unreacted starting materials can be removed from the surface. This can be performed, in one example, by rinsing the surface in copious water and then drying the surface (e.g., using active drying, such as a vacuum filter, or passive drying). Though the amount of explosive product used in this process is significantly less (per unit, since it is diluted) than that required to construct an explosive device, the surface can exude vapors of the explosive at a rate that is at least comparable to an amount of explosive powder used in an explosive device. This is shown in example testing scenarios, as described below. The removed surface can be used as the manufactured training aid material, or can otherwise be used in constructing a training aid for the explosive powder. In this regard, a non-detonable explosive device training aid is constructed without using solvents or other products that can cause off-odors.

In one example, the explosive product can include hexamethylene triperoxide diamine (HMTD). Thus, in a specific example, HMTD training aid materials can be produced by preparing a dilute solution of the reaction mixture at operation 302 and depositing the solution onto glass microfiber filters prior to formation of the HMTD product at operation 304. HMTD training aids can also be produced by adding an inert, high purity, high surface area diluent such as DE powder, to the dilute reaction mixture prior to formation of the HMTD, allowing the HMTD to deposing on the high surface area diluents, at operation 304.

In one specific example, the dilute solution can be prepared at operation 302 by diluting 19 g of 35% hydrogen peroxide to 15% by the addition of 25 g water, dissolving 7 g hexamine in the diluted peroxide, and cooling the reaction mixture in an ice bath to below 10° C. In addition, the preparation at operation 302 can also include adding 11 g citric acid to the peroxide/hexamine solution in portions with continuous stirring while keeping the temperature below 10° C. As described, the ice bath can prevent the explosive reaction mixture from reacting to immediately form the explosive product HMTD. It is to be appreciated that different amounts or substances can be used, so long as the resulting compound is HMTD. After the citric acid is dissolved, the solution can be deposited onto clean glass microfiber filters (~1.3 g solution per 190 mg filter), each in their own aluminum weighing dish at operation 304. The solution is allowed to react in the filter for a minimum of 3 hours or left overnight either at ambient condition or refrigerated, at operation 306. The next day, the filters are removed at operation 308. The filters can also be individually rinsed in copious water to remove any unreacted starting materials and partially dried on a vacuum filter funnel at operation 310. The filters are then stacked on the filter funnel and dried completely by pulling air through them using a vacuum filtration apparatus. The dried filters can then be used as non-detonable HMTD training aids.

In another specific example, the dilute solution is prepared at operation 302 by diluting 19 g of 35% hydrogen peroxide to 13% by the addition of 32.6 g water, dissolving 7 g hexamine in the diluted peroxide, and cooling the reaction mixture in an ice bath to below 10° C. In addition, at operation 302, the solution can be prepared by adding 11 g citric acid to the peroxide/hexamine solution in portions with continuous stirring while keeping the temperature below 10° C. Immediately after all of the citric acid has dissolved, 7.6 g of DE is added with stirring to the reactant solution to allow HMTD to deposit over the entire surface of the inert matrix at operation 304. The entire mixture is kept in the ice bath, and stirring is continued for a minimum of 3 hours or preferably left overnight to allow the reactant mixture to warm slowly to room temperature at operation 306. It is to be appreciated that a longer reaction time can provide better yield and higher loading of HMTD on the DE matrix. Subsequently, the mixture is removed at operation 308, and used in the construction of training aid materials.

In specific testing scenarios, it was determined that when the peroxide solution is used close to full strength, the HMTD loading is much higher and results in training aids that may not pass the sensitivity testing. For example, using only 3.5 g water in preparing the dilute solution at operation 302 (effectively 30% hydrogen peroxide concentration) produces filters with an estimated 36% HMTD mass loading. Using only 3.5 g water produces P300 powder with an estimated loading of 47% HMTD. In a specific example, suitable HMTD mass loading can be expected to be in the 15-20% range, and this may be achieved by diluting the peroxide solution at operation 302 to approximately 15% concentration and by selecting filters with a high basis weight (~200 mg each) or by reducing the storage (reaction) time at operation 306 (but not less than 3 hours). The following table shows example peroxide ($H_2O_2$) concentrations and relative HMTD mass loading.

| $H_2O_2$ Concentration | Matrix Mass, g | Solution Mass, g | HMTD Mass Loading |
|---|---|---|---|
| 35% | 0.180 filter | 1.472 | 36% (estimated) |
| 35% | 0.176 filter | 1.355 | 36% (estimated) |
| 18% | 0.127 filter | 1.05 | 28% (measured) |
| 18% | 0.198 filter | 0.927 | 22% (measured) |
| 15% | 0.200 filter | 1.27 | 18% (measured) |
| 15% | 0.200 filter | 1.32 | 16% (measured) |
| 29% (2 h 24 m) | 4.2 P300 | 36% of 100% HMTD yield | 47% (estimated) |
| 13% (12 h 47 m) | 7.6 P300 | 72% of 100% HMTD yield | 38% (estimated) |

In an example testing scenario, HMTD loaded filters or DE powder burned vigorously, but weaker than neat HMTD in flame tests; neither showed detonation tendencies in the flame tests. Preliminary impact test results in the example testing scenario indicated that higher loading (>30%) filters and DE powder were initiated by the drop of a 5.640 kg weight from a height of 2.6 inches onto a 0.25" diameter surface. Lower loading filters (22%) were less consistently initiated in the same drop test. 36% HMTD loaded filters and 22% HMTD loaded DE powder both passed the United Nations impact test criterion, as shown in the table below presenting results of example testing, but neither passed the friction test in this example testing. The lower loaded DE powder came closer to passing the friction test, which suggests that lowering the loading on both types of training aids should allow both to pass these tests and fall outside of the dangerous goods shipping requirements.

| Training Aid Sample | BOE Impact Test Results | BAM Friction Test Results |
|---|---|---|
| 36% HMTD on 4.25 cm filter | No positive results in trials conducted at drop heights of up to 30 inches | Limiting load < 5N |
| 22% HMTD/P300 | | Limiting load = 48N |
| Neat (100%) HMTD | $H_{50}$ positive distance = 5.92 cm | Limiting load < 5N |

In this testing example, two 1 gram samples of HMTD/P300 were separately wrapped into ~1"×2" foil packets and initiated with electric matches. One sample contained nominally 47% HMTD by mass, and the other contained nominally 22% HMTD by mass. Both packets simply puffed up on initiations but did not detonate. For comparison, one gram neat HMTD similarly prepared detonated with a loud report and observable detonation wave.

In additional example testing, a group of four canines (EDDs) that had never been exposed to neat HMTD were imprinted on a freshly prepared 4.25 cm filter containing an estimated 40 mg (17%) HMTD. Blind testing showed that these canines successfully located not only the freshly prepared HMTD filter training aids, but also aged HMTD loaded filters, HMTD/P300 training aids, and 1 g neat HMTD that was synthesized by an external organization. A group of seven canines that had trained on 1 g neat HMTD synthesized by an external organization successfully located both the freshly prepared and aged HMTD loaded filters. The table below summarizes results of this example testing.

| | Test Aids - # detection/# exposures (detection rate) | | |
|---|---|---|---|
| Imprint aid | 1 g neat HMTD | Fresh HMTD filter | Aged HMTD filter |
| Fresh HMTD filter | 7/9 (78%) | 9/9 (100%) | 9/9 (100%) |
| 1 g neat HMTD | 15/20 (75%) | 17/20 (85%) | 21/21 (100%) |

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A method for manufacturing training aid materials for detecting homemade explosives, comprising:

spreading an explosive powder on a porous surface;

storing the porous surface in a container that facilitates sublimation of the explosive powder for at least a period of time sufficient to enable the sublimed explosive powder to redeposit onto the porous surface; and removing the porous surface having the redeposited explosive powder from the container after the period of time.

2. The method of claim 1, wherein the surface comprises a glass microfiber filter, and the sublimed explosive powder redeposits over the porous surface and into pores of the glass microfiber filter as part of the sublimation.

3. The method of claim 1, wherein the container comprises a plurality of aluminum foil layers, and the storing the porous surface comprises wrapping the porous surface between the plurality of aluminum foil layers.

4. The method of claim 1, wherein the container comprises one or more substantially circular aluminum dishes having a similar diameter as a diameter or length of the porous surface.

5. The method of claim 1, wherein the container comprises a glass jar with a substantially air tight lid.

6. The method of claim 1, wherein the spreading comprises blending the explosive powder with the porous surface, and wherein the surface comprises an inert, porous, high surface area carrier.

7. The method of claim 6, wherein the inert carrier comprises diatomaceous earth.

8. The method of claim 1, wherein the explosive powder comprises pure triacetone triperoxide (TATP) powder.

9. The method of claim 1, wherein a ratio of an area of the surface to an amount of the explosive powder spread on the surface results in a mass loading of the explosive powder over the surface in the range of 5-15%.

10. A method for manufacturing training aid materials for detecting homemade explosives, comprising:

preparing a dilute solution of an explosive reaction mixture;

depositing the dilute solution on a surface prior to formation of an explosive product by the explosive reaction mixture;

storing the surface in a container that facilitates formation of the explosive product and forming the explosive product by reacting the explosive gas reaction mixture on the surface over a period of time; and removing the surface from the container after the period of time.

11. The method of claim 10, further comprising removing unreacted starting materials from the surface after the removing from the container.

12. The method of claim 11, wherein the removing the unreacted starting materials comprises:

rinsing the surface in copious water; and vacuum filtering the surface to dry the explosive product.

13. The method of claim 10, wherein the surface comprises a glass microfiber filter.

14. The method of claim 10, wherein the surface comprises an inert, porous, matrix.

15. The method of claim 14, wherein the inert matrix comprises diatomaceous earth.

16. The method of claim 10, wherein the explosive reaction mixture comprises a solution of hydrogen peroxide, hexamine, and citric acid before hexamethylene triperoxide diamine (HMTD) has formed.

17. The method of claim 16, wherein the preparing the dilute solution of the explosive reaction mixture comprises:

diluting the hydrogen peroxide with an amount of water to create a diluted hydrogen peroxide;

adding an amount of the hexamine to the diluted hydrogen peroxide to create a mixture;

cooling the mixture in an ice bath; and adding the citric acid to the mixture to yield the dilute solution of a neat HMTD.

18. A method for manufacturing training aid materials for detecting homemade explosives, comprising:

preparing a dilute solution of an explosive reaction mixture;

depositing the dilute solution on a surface prior to formation of an explosive product by the explosive reaction mixture;

storing the surface in a container that facilitates formation of the explosive product and forming the explosive product by reacting the explosive gas reaction mixture on the surface over a period of time; and removing the surface from the container after the period of time, wherein the training aid materials are non-detonable, and the training aid materials have substantially no off-odor.

* * * * *